United States Patent [19]

Dayen

[11] 4,125,192

[45] Nov. 14, 1978

[54] GAME EQUIPMENT SUPPORT RACK

[76] Inventor: John Dayen, 13810 N. 31 Ave., Phoenix, Ariz. 85023

[21] Appl. No.: 803,547

[22] Filed: Jun. 6, 1977

[51] Int. Cl.[2] ..... A47F 7/00

[52] U.S. Cl. ..... 211/14; 273/30

[58] Field of Search ..... 273/30, 14, 76; D6/114, D6/125, 132; 211/126, 153, 13, 14, 15, 60 T, 60 R, 60 A, 60 M, 90, 71, 88, 74, 73, 14; 248/111, 30; 108/24, 25, 27, 28

[56] References Cited

U.S. PATENT DOCUMENTS

| | | | |
|---|---|---|---|
| 58,715 | 8/1921 | Conoma | 211/14 |
| 242,408 | 11/1976 | Enckler | D6/125 |
| 713,762 | 11/1902 | Haskell | 273/30 |
| 2,590,732 | 3/1952 | Simanick | 211/126 |
| 3,064,823 | 11/1962 | Shock | 211/13 |
| 3,128,021 | 4/1964 | Habbena | 211/14 |
| 3,233,940 | 2/1966 | Tooley, Jr. | 211/73 |
| 3,650,407 | 3/1972 | Benhan, Jr. | 211/14 |
| 3,858,725 | 1/1975 | Pietrack | 211/13 |

*Primary Examiner*—Richard C. Pinkham

*Assistant Examiner*—T. Brown

*Attorney, Agent, or Firm*—Henry G. Kohlmann

[57] ABSTRACT

A game apparatus holder for supporting a conventional type ball striking device and conventional type balls in such a manner that the ball striking device head portion is prevented from contacting any surface and thereby preventing warp or strain thereof. The apparatus further has a slot having a U-shaped trough therebeneath for supporting balls placed therein. The apparatus is provided with a vertical planar element structured for supporting the apparatus on a vertical wall, and a horizontal planar element attached perpendicular to the vertical element. The horizontal element is provided with a plurality of parallel slots for holding ball striking devices and at least one slot having a U-shaped trough underneath for holding balls. The ball striking device slots are dimensioned in width such that the handle portion of the ball striking device will not pass therethrough after the head portion is inserted therein, and the ball slot has a width wider than that of the ball striking device slots and is positioned parallel thereto.

8 Claims, 2 Drawing Figures

GAME EQUIPMENT SUPPORT RACK

BACKGROUND OF THE INVENTION

1. Field of the Invention

This invention relates to devices used for the supporting of apparatus used for the playing of table tennis. In particular, the secure holding of ping pong paddles and table tennis balls so that such equipment remains easily accessible.

2. Description of the Prior Art

The prior art regarding such devices is rather sparce, however, it is typified by U.S. Pat. No. 713,762 by Haskell. However, such devices hold the paddles such that both the handle and the paddle head are in contact with the supporting device. Accordingly, such devices cause abrasion and wear of the paddle head with the result that the paddle head fabric becomes separated from the paddle head and in many cases the paddle head board itself becomes warped.

The means shown in prior art devices for holding the table tennis balls is simply a container supporting device designed without regard to the shaking of the holder itself and allows the balls as well as the paddles to be shaken out of position on the holder and thereby fall to the floor thus becoming lost or damaged.

It is an object of this invention to provide a holder that will support table tennis paddles in such a manner that they cannot be shaken out of the holding device and which further holds the paddles such that the paddle heads do not contact the device or each other thus preventing the abrasion wear and warping of paddle heads.

It is a further object of this invention to provide a ball holding apparatus which allows easy removal thereof but which will prevent such balls from being shaken out of the apparatus holder.

DESCRIPTION OF THE PREFERRED EMBODIMENT

Figure 1:
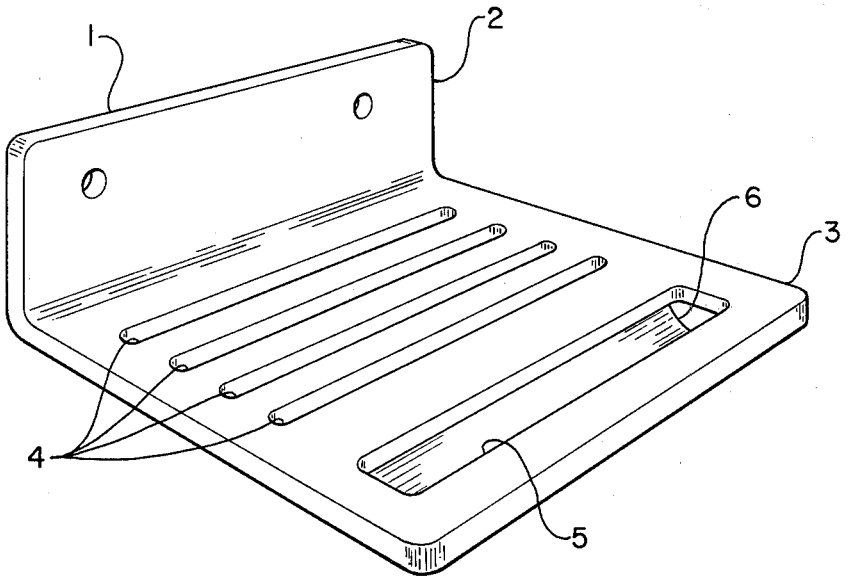
FIG. 1 is a three-dimensional view of the table tennis apparatus holder.
Figure 2:
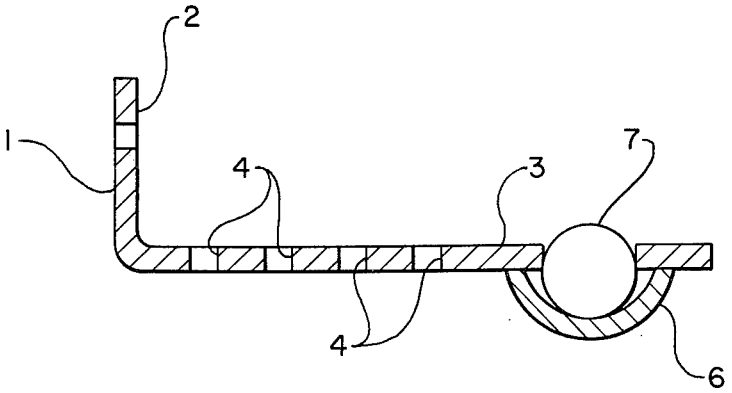
FIG. 2 is a sectional side view of said ping pong apparatus holder.

With reference to the drawings, FIG. 1 shows the ping pong apparatus holder 1 comprising a vertically disposed plate 2 having two holes adapted for receiving mounting screws (not shown) such that said holder may be fixedly attached to any vertical surface. Depending horizontally from said vertical plate 2 is a horizontal plate 3 having a plurality of slots 4 adjacent to said vertical plate 2 and parallel therewith, and a generally rectangular shaped hole 5 parallel to said slots at a point remote from said vertical plate 2 adapted for receiving ping pong balls. Attached to the bottom of horizontal plate 3 is an elongated member having a generally "U" shaped cross-section. Said "U" shaped member 6 being positioned such that the bight of said "U" is directly below said hole 5 and the arms thereof attach to said horizontal plate 3 on either side of and spaced apart from said hole 5 underneath said horizontal plate 3. Said elongated member depends downward from the plate 3 such that a ping pong ball 7 resting in said hole 5, and on the bight of said elongated member 6 extends one quarter of its diameter above the upper surface of horizontal plate 3. This allows the easy removal of table tennis balls from the holder when the upper one quarter thereof is grasped by the fingers and yet the center of gravity of said ball 7 is well below the surface of said horizontal plate 3 such that any vibration or impact against said holder 1 will not cause said ball to be impelled out of said hole 5. In fact the impact visited on a table tennis ball 7 in said holder is directed at a point above the center of gravity thereof by the sides of said hole 5 which tends to keep the ball 7 in place. The arms of said elongated member 6 do not contact the ball 7 and thus the only point of impact which would cause the ball 7 to be impelled out of said holder 1 is a blow directly underneath the bight of the "U" of said elongated member 6 and directed in a substantially vertical direction. Hence, the ball 7 will remain in the holder until removed for use.

The slots 4 are of sufficient width to receive the paddle head of table tennis paddles without said paddle head touching the sides of said slots 4 but are sufficiently narrow to prevent the handles of said table tennis paddles from entering said slots 4. Thus, when a table tennis paddle is inserted therein it is held with the paddle head in a downward position by the handle. Said slots 4 are spaced apart a distance sufficient to prevent contact between adjacent paddle boards. Accordingly, said paddles are held such that no wear or abrasion can occur to the paddle heads. They are also held such that the paddle heads are underneath the holder and protected from falling objects. Finally, since the holder 1 prevents contact between paddle heads and any other object no strain is placed on said heads to cause warping thereof.

The foregoing is considered illustrative only of the principles and specific embodiment of the invention. Further, since numerous modifications and changes will readily occur to those skilled in the art, it is not intended to limit the invention to strictly that described herein but such is to include all modifications and equivalents falling within the scope of the invention herein claimed including, of course, other games in which balls or ball striking members are utilized.

What is claimed is:

1. A game apparatus holder comprising:

a. a vertical member having a means for attaching the same to a wall or other surface;

b. a horizontal member depending from said vertical member having a plurality of slots spaced apart; and c. an elongated "U" shaped member attached at its arms to the lower surface of said horizontal member, each arm of said U-shaped member extending along opposite sides of at least one of said slots to thereby define a trough-like receptacle beneath said slot.

2. The game apparatus holder as described in claim 1, wherein said apparatus including at least one conventional-type ball and at least one conventional-type striking member, said striking member having a handle portion and a ball striking portion for striking said ball, at least a portion of said handle portion having a larger dimension than said ball striking portion; said apparatus further comprising at least one second slot of sufficient width to receive said striking portion but being sufficiently narrow to engage said handle portion thereof, whereby said striking portion may be inserted into said slot and held by said handle portion with said striking portion depending downward and underneath said holder.

3. In an apparatus holder as described in claim 1 wherein the bight said U-shaped member depends below the surface of said horizontal member a distance greater than one half the width of said first slot, whereby a ball insertable through said slot will have a center of gravity below the surface of said horizontal member and will be supported by said "U" shaped member.

4. The apparatus holder as described in claim 3 wherein the sides of said wide slot are spaced apart a distance substantially equal to the diameter of said conventional type ball and a distance smaller than the distance between the arms of said "U" shaped member.

5. A game equipment holder for supporting at least one conventional type ball and at least one conventional type hand held ball striking device having a handle portion and a ball striking portion, at least a portion of said handle portion having a larger dimension than said ball striking portion comprising:

a. a first plate;

b. a second plate attached to the first plate at substantially 90° thereto, said second plate having at least one narrow slot and at least one slot wider than said narrow slot;

(1) said narrow slot being of sufficient width to receive said striking portion of said hand held ball striking device but sufficiently narrow to prevent passage of said handle portion of said device through said slot.

(2) said wider slot being sufficiently wide to receive said conventional type ball used with said striking device, and c. an elongated "U" shaped member attached at its arms to the lower surface of said horizontal member, each arm of said U-shaped member extending along opposite sides of said wide slot to thereby define a trough-like ball receiving trough beneath said wide slot;

(1) the bight of said U-shaped member is disposed away from said second plate such that a ball resting on the concave surface of said bight has its center of gravity below the surface of said second plate.

6. A game equipment holder as described in claim 5 wherein there are a plurality of narrow slots.

7. The game equipment holder as described in claim 5 wherein said "U" shaped member supports a ball such that at least one fourth of its diameter protrudes above the surface of said second plate.

8. The game equipment holder as described in claim 5 wherein said plates are generally rectangular.

* * * * *